US007302876B1

(12) United States Patent
Lee

(10) Patent No.: US 7,302,876 B1
(45) Date of Patent: Dec. 4, 2007

(54) BI-SECTIONAL WRENCH

(76) Inventor: Yi-Min Lee, No.72, Chaoguei Rd., Situn District, Taichung City 407 (TW)

( * ) Notice: Subject to any disclaimer, the term of this patent is extended or adjusted under 35 U.S.C. 154(b) by 0 days.

(21) Appl. No.: 11/696,718

(22) Filed: Apr. 4, 2007

(51) Int. Cl.
*B25B 23/16* (2006.01)
*B25B 13/46* (2006.01)
*B25B 13/00* (2006.01)

(52) U.S. Cl. ..... 81/177.9; 81/177.7; 81/177.8; 81/63.2

(58) Field of Classification Search .... 81/177.7–177.9, 81/58.3–58.5, 60–63.2
See application file for complete search history.

(56) References Cited

U.S. PATENT DOCUMENTS 4,406,186 A * 9/1983 Gummow ..... 81/60
5,419,221 A * 5/1995 Cole ..... 81/60
5,535,648 A * 7/1996 Braun et al. ..... 81/63.1
5,941,141 A * 8/1999 Whitley ..... 81/63.1
6,000,299 A * 12/1999 Cole ..... 81/60
6,101,907 A * 8/2000 McGovern et al. ..... 81/177.8
6,161,982 A * 12/2000 Cole ..... 403/97
6,216,565 B1 * 4/2001 McCann ..... 81/177.8
6,840,141 B2 * 1/2005 Cole ..... 81/177.8
6,928,904 B2 * 8/2005 Hsien ..... 81/60

* cited by examiner

*Primary Examiner*—Alvin J. Grant
(74) *Attorney, Agent, or Firm*—Banger Shia

(57) ABSTRACT

A wrench includes a lever with teeth formed on the wall of a space defined therein. A handle includes teeth formed on the wall of a space defined therein. A toothed wheel is movable in the spaces between a first position where the teeth of the toothed wheel are engaged with the teeth of the lever and handle and a second position where the teeth of the toothed wheel are only engaged with the teeth of one of the lever and handle. A switch is operable for moving the toothed wheel between the positions. A boss is formed on the handle. A groove is defined in the switch. The arrival at the first position is signaled by the contact of the boss with an end of the groove while the arrival at the second position is signaled by the contact of the boss with another end of the groove.

12 Claims, 6 Drawing Sheets

BI-SECTIONAL WRENCH

BACKGROUND OF INVENTION

1. Field of Invention

The present invention relates to a wrench and, more particularly, to a bi-sectional wrench.

2. Related Prior Art

A typical wrench includes a single-pieced design that includes a handle and a head formed at an end of the handle. Such a single-pieced wrench can be used in an open space; however, it cannot conveniently be used in a limited space.

There are some wrenches that include two sections. Examples of such bi-sectional wrenches can be found in Taiwanese Patent Publication Nos. 450185 and 569860 and Taiwanese Patents I241940 and I242483. The bi-sectional wrenches can be switched between modes. In the first mode, the angle between the sections is retained. In the second mode, the angle between the sections can be changed. The bi-sectional wrenches are however normally kept in the first mode. The sections are normally pivoted by a common angular speed. It is however difficult to maneuver the bi-sectional wrenches this way in limited space.

To overcome the foregoing problem, a bi-sectional wrench has been disclosed in Taiwanese Patent M302441. This conventional bi-sectional wrench includes a lever 10, a handle 20 and a connecting device to pivotally connect the lever 10 to the handle 20. The connecting device 30 includes a switch 38 that can be turned to switch the connecting device 30 between locking and unlocking positions. In the locking position, the connecting device 30 retains the angle between the lever 10 and the handle 20. In the unlocking position, the connect device allows the change of the angle between the lever 10 and the handle 20. It is however difficult to precisely turn the switch 38 to switch the connecting device 30.

The present invention is therefore intended to obviate or at least alleviate the problems encountered in prior art.

SUMMARY OF INVENTION

The primary objective of the present invention to provide a wrench that can be switched between a first mode in which two sections thereof are pivoted by a common angular speed and a second mode in which the sections are pivoted by different angular speeds so that the switch to the first and second modes is signaled.

According to the present invention, a wrench includes a lever with teeth formed on the wall of a space defined therein. A handle includes teeth formed on the wall of a space defined therein. A toothed wheel is movable in the spaces between a first position where the teeth of the toothed wheel are engaged with the teeth of the lever and handle and a second position where the teeth of the toothed wheel are only engaged with the teeth of one of the lever and handle. A switch is operable for moving the toothed wheel between the positions. A boss is formed on the handle. A groove is defined in the switch. The arrival at the first position is signaled by the contact of the boss with an end of the groove while the arrival at the second position is signaled by the contact of the boss with another end of the groove.

Other objectives, advantages and features of the present invention will become apparent from the following description referring to the attached drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figures 1, 9:
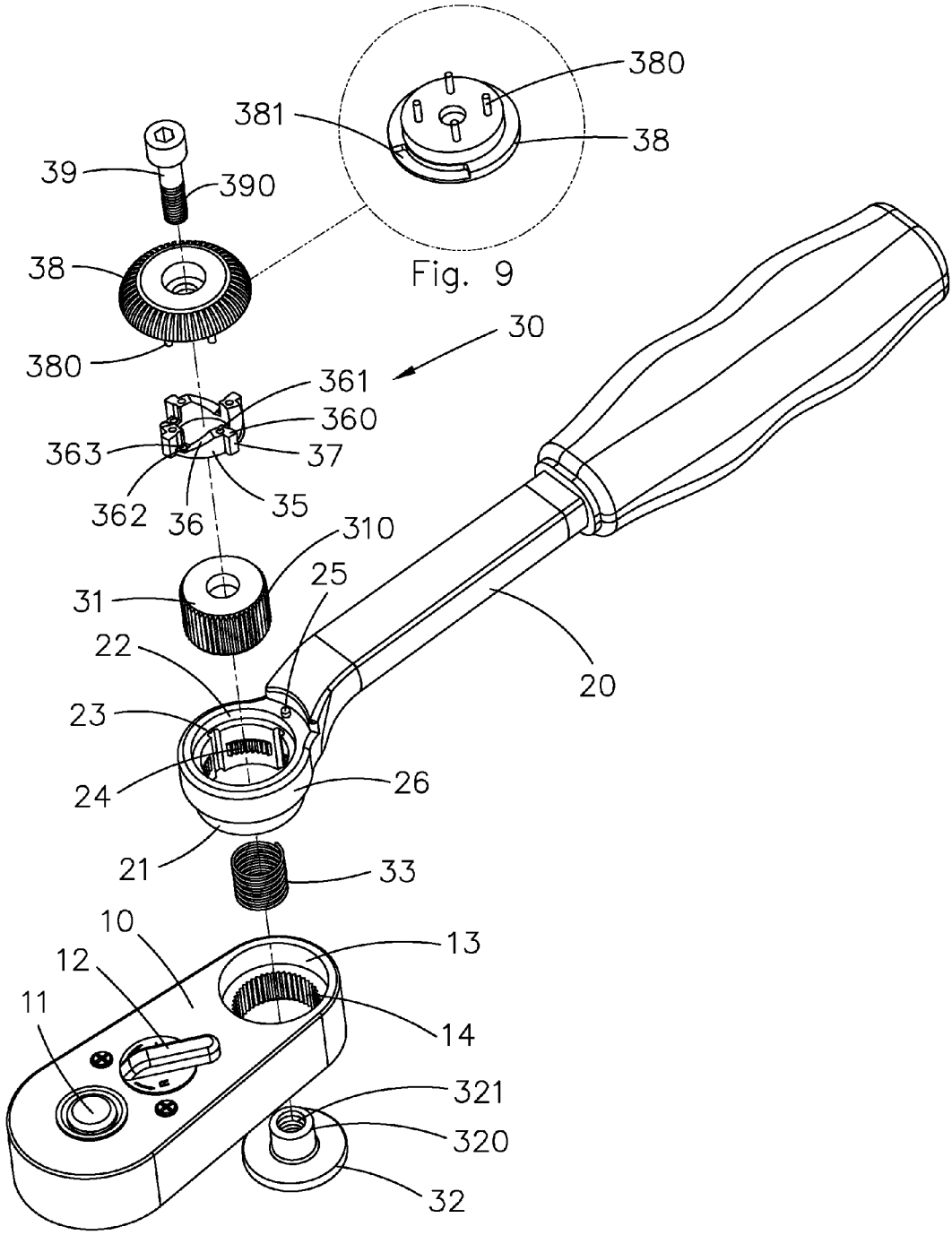
FIG. 1 is an exploded view of a bi-sectional wrench according to the preferred embodiment of the present invention.
FIG. 9 is a perspective view of a switch of the bi-sectional wrench shown in FIG. 1.
Figure 2:
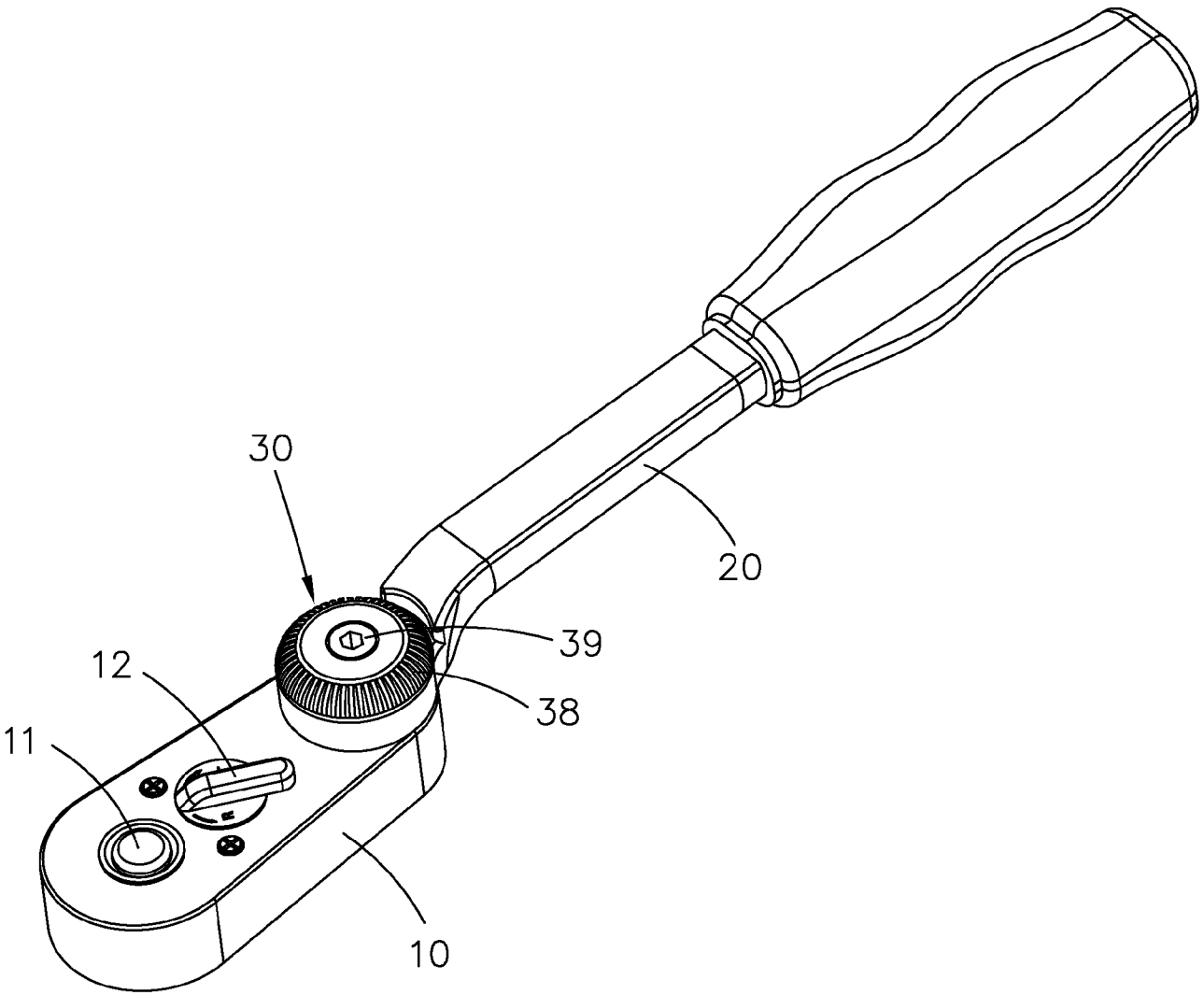
FIG. 2 is a perspective view of the bi-sectional wrench of FIG. 1.
Figure 3:
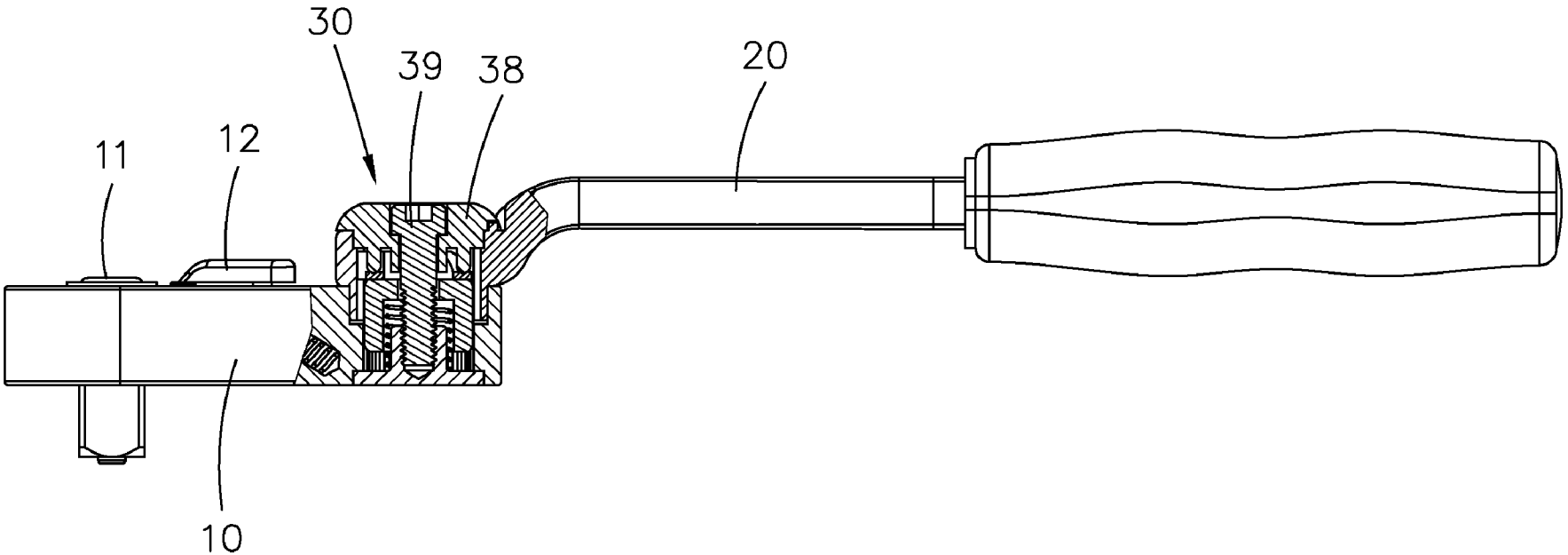
FIG. 3 is a cut-away view of the bi-sectional wrench shown in FIG. 2.

Referring to FIGS. 1 through 3, there is shown a bi-sectional wrench according to the preferred embodiment of the present invention. The bi-sectional wrench includes a lever 10, a handle 20 and a connecting device 30 for pivotally connecting the handle 20 to the lever 10.

The lever 10 includes a selective one-way driver 11 provided at a first end, a space 13 defined in a second end opposite to the first end and a switch 12 connected to the selective one-way driver 11.

The selective one-way driver 11 is preferably used together with a socket. The selective one-way driver 11 includes a square insert. The socket defines a square recess in a first end and a hexagonal recess in a second end opposite to the first end. The square insert of the selective one-way driver 11 can be inserted in the square recess of the socket. The selective one-way driver 11 can drive the socket in a selected one of two opposite directions.

The switch 12 can be operated to select from the opposite sections of the selective one-way driver 11. The switch 12 and the selective one-way driver 11 will not be described in detail for being conventional.

The wall of the space 13 includes an upper portion and a lower portion. Teeth 14 are formed on the lower portion of the wall of the space 13.

The handle 20 includes a grip provided at an end and a ring 26 formed at an opposite end. The ring 26 includes a space 22 defined therein, four groups of teeth 24 formed on the wall of the space 22 and four grooves 23 defined in the wall of the space 22 so that the groups of teeth 24 are separated from one another by the grooves 23. A reduced edge 21 is formed on the bottom of the ring 26. A boss 25 is formed on the top of the ring 26.

The connecting device 30 includes a toothed wheel 31, an elastic element 33, a pusher 35, a switch 38, a cover 32 and a fastener 39.

The toothed wheel 31 by nature includes a plurality of teeth 310 formed on the periphery. The toothed wheel 31 is positioned in the space 22. The toothed wheel 31 can be moved between a first position and a second position. In the first position, the teeth 310 of the toothed wheel 31 are engaged with the teeth 24 of the handle 20 and the teeth 14 of the lever 10 so as to retain the angle between the lever 10 and the handle 20. In the second position, the teeth 310 of the toothed wheel 31 are engaged with only the teeth 14 of the lever 10 so as to allow the change of the angle between the lever 10 and the handle 20.

Also positioned in the space 22 is the elastic element 33 for biasing the toothed wheel 31 to the first position. The elastic element 33 may be in the form of a helical spring.

The pusher 35 includes four slides 37 formed on the periphery thereof and four slopes 36 formed on the bottom thereof. Each of the slopes 36 includes an upper end 360 defining an upper hole 361 and a lower end 362 defining a lower hole 363. The pusher 35 is positioned in the space 22. The slides 37 are positioned in the grooves 23 so that the pusher 35 is movable but not rotational in the space 22.

As best shown in FIG. 9, the switch 38 includes four rods 380 formed on the bottom thereof and an arched groove 381 defined in the bottom thereof. The arched groove 381 includes two ends.

Figure 4:
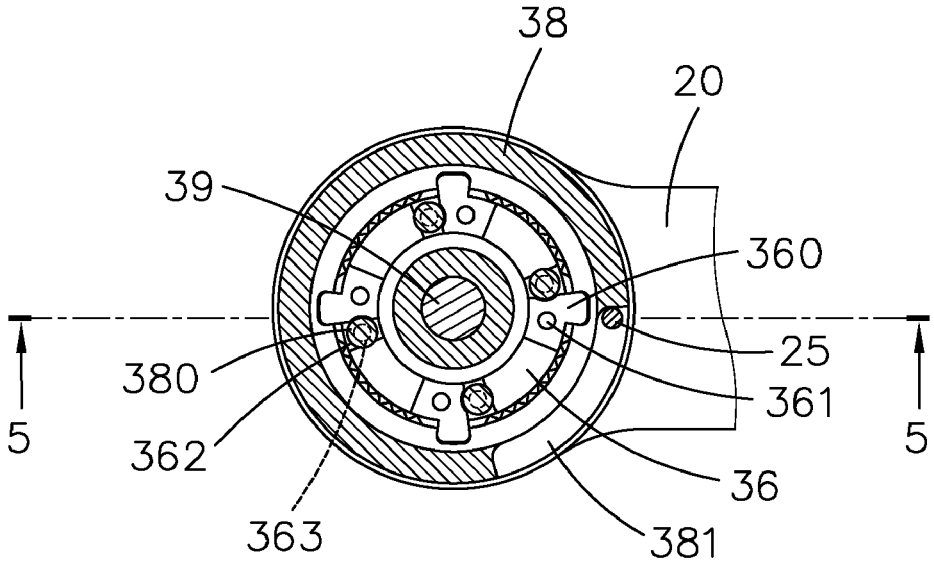
FIG. 4 is an enlarged partial cross-sectional view of the bi-sectional wrench shown in FIG. 3.
Figure 5:
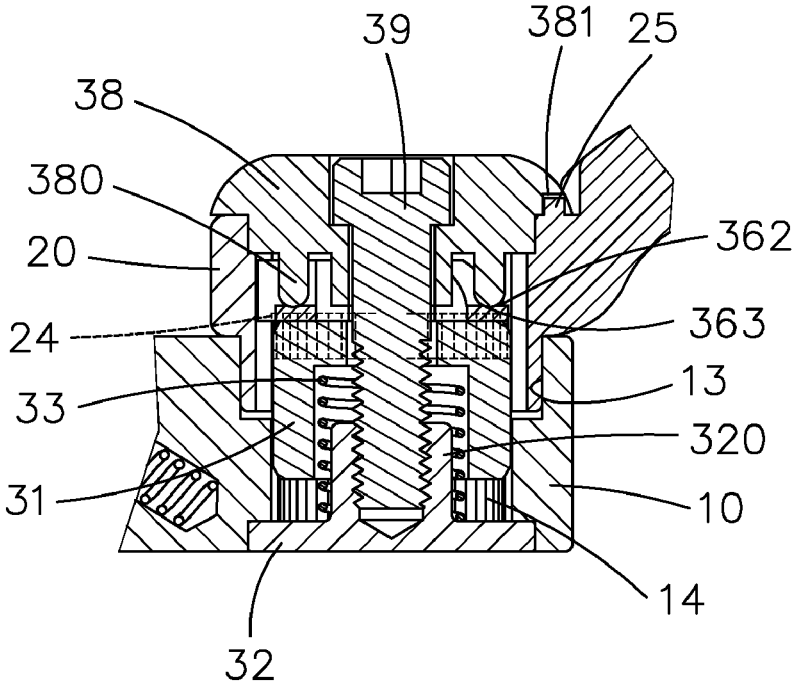
FIG. 5 is a cross-sectional view of the bi-sectional wrench taken along a line 5-5 in FIG. 4.

Referring to FIGS. 4 and 5, the switch 38 is rotationally installed on the pusher 35 and the ring 22. The rods 380 are movably located on the slopes 36. The boss 25 is disposed in the arched groove 381.

The cover 32 includes a tube 320 formed on the top thereof. The cover 32 is positioned beneath the reduced edge 21 of the ring 26. The tube 320 is inserted in the elastic element 33. A thread 321 is formed on an internal side of the tube 320.

The fastener 39 is preferably a threaded bolt formed with a thread 390. The fastener 39 is inserted through an aperture defined in the switch 380, an aperture defined in the pusher 35, an aperture defined in the toothed wheel 31 and a tunnel defined by the elastic element 33. The thread 390 of the fastener 39 is engaged with the thread 321 of the cover 32 so that these elements are firmly connected to the lever 10.

Referring to FIGS. 4 and 5, the switch 38 is turned to a first position where the rods 380 are inserted in the lower holes 363. The arrival of the switch 38 to the first position is clearly signaled by the contact of the boss 25 with one of the ends of the arched groove 381. The toothed wheel 31 is pushed to the first position by the elastic element 33. The teeth 310 of the toothed wheel 31 are engaged with the teeth 14 of the lever 10 and the teeth 24 of the handle 20. The angle between the handle 20 and the lever 10 is retained.

Figure 6:
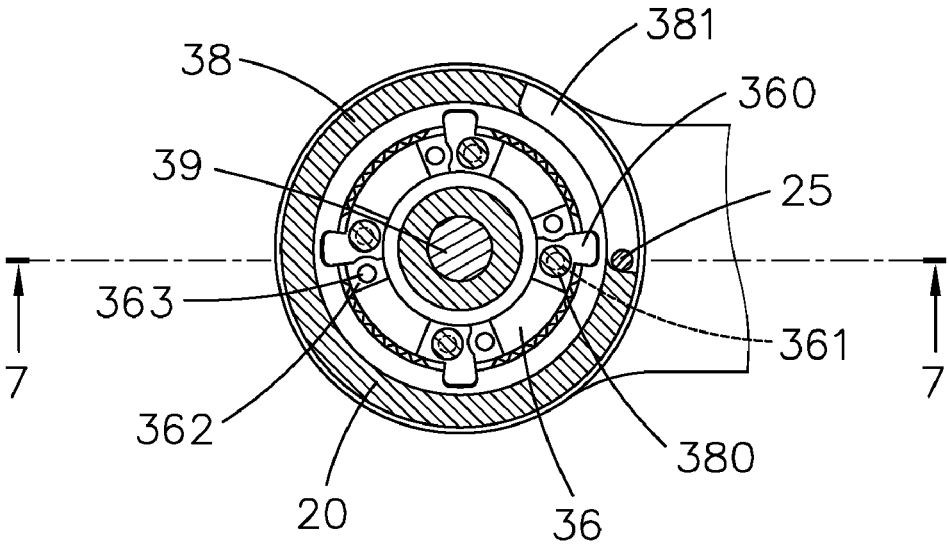
FIG. 6 shows the bi-sectional wrench in another position than shown in FIG. 4.
Figure 7:
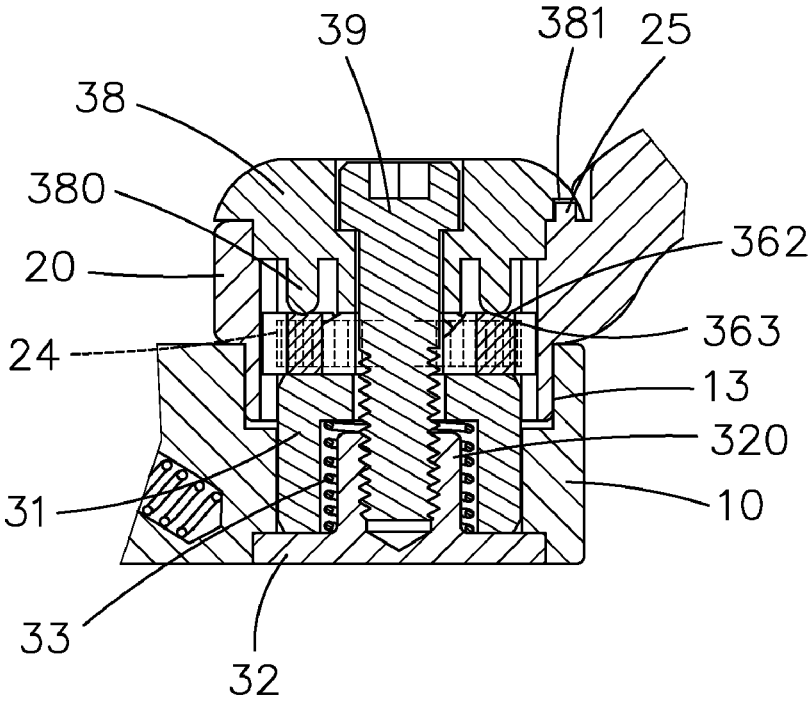
FIG. 7 is a cross-sectional view of the bi-sectional wrench taken along a line 7-7 in FIG. 6.
Figure 8:
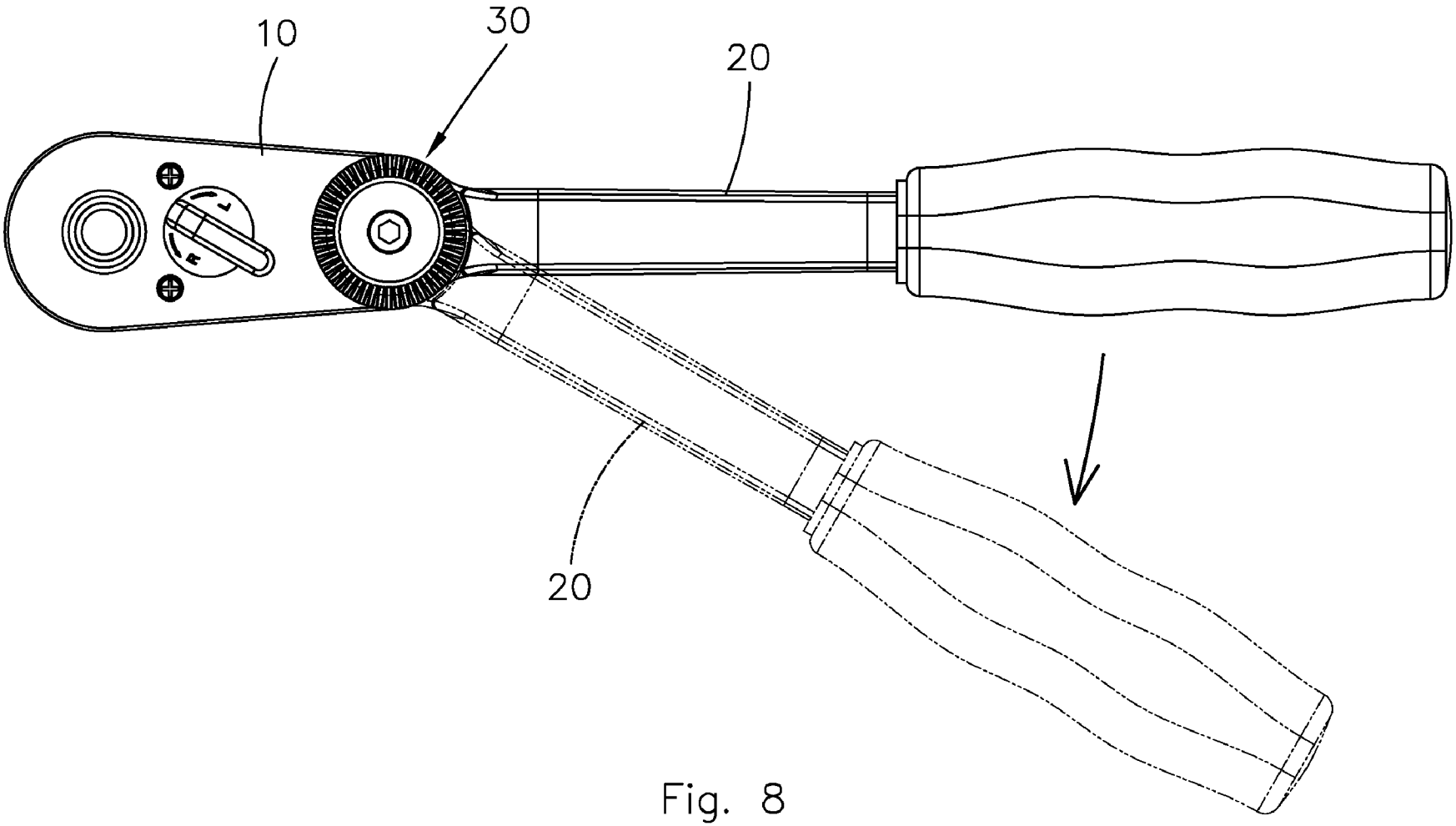
FIG. 8 is a top view of the bi-sectional wrench of FIG. 2, showing the bi-sectional wrench in various positions in use.

Referring to FIGS. 6 and 7, the switch 38 is turned to a second position where the rods 380 are inserted in the upper holes 361. The arrival of the switch 38 to the second position is clearly signaled by the contact of the boss 25 with the other end of the arched groove 381. While a user is pushing the switch 38 to the second position from the first position, the user are moving the tips of the rods 380 on the slopes 36, thus pushing down the pusher 35. Thus, the user is pushing the toothed wheel 31 to the second position from the first position against the force of the elastic element 33. The teeth 310 of the toothed wheel 31 are engaged with only the teeth 14 of the lever 10. Therefore, angular movement between the handle 20 and the lever 10 is allowed.

The present invention has been described through the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A bi-sectional wrench comprising:

a lever comprising a space defined therein and teeth formed on the wall of the space;

a handle comprising a space defined therein and teeth formed on the wall of the space;

a toothed wheel movable in the spaces between a first position where the teeth of the toothed wheel are engaged with the teeth of the lever and handle and a second position where the teeth of the toothed wheel are only engaged with the teeth of one of the lever and handle;

a switch operable for moving the toothed wheel between the first and second positions;

a boss formed on one of the handle and switch; and a groove defined in the other of the handle and switch and formed with two ends so that the arrival at the first position is signaled by the contact of the boss with one of the ends of the groove while the arrival at the second position is signaled by the contact of the boss with the other end of the groove.

2. The bi-sectional wrench according to claim 1 wherein the boss is formed on the handle while the groove is defined in the switch.

3. The bi-sectional wrench according to claim 1 comprising a pusher for pushing the toothed wheel under the control of the switch.

4. The bi-sectional wrench according to claim 3 wherein the pusher is moved but not rotated when the switch is rotated.

5. The bi-sectional wrench according to claim 4 wherein the pusher comprises at least one slope formed on a side, wherein the switch comprises at least one rod formed on a side, wherein the tip of the rod of the switch travels on the slope of the pusher so that the switch pushes the pusher when the switch is rotated relative to the pusher.

6. The bi-sectional wrench according to claim 5 wherein the slope comprises a lower end defining a lower hole for receiving the tip of the rod in the first position of the toothed wheel and an upper end defining an upper hole for receiving the tip of the rod in the second position of the toothed wheel.

7. The bi-sectional wrench according to claim 4 wherein one of the handle and the lever defines a groove in the wall of the space, wherein the pusher comprises at least one slide movable in the groove.

8. The bi-sectional wrench according to claim 3 comprising an elastic element for biasing the toothed wheel to the first position.

9. The bi-sectional wrench according to claim 8 comprising a cover for supporting the elastic element.

10. The bi-sectional wrench according to claim 9 comprising a fastener for fastening the cover to the switch.

11. The bi-sectional wrench according to claim 1 wherein the lever comprises a selective one-way driver for driving a bit in a selected one of two opposite directions.

12. The bi-sectional wrench according to claim 11 wherein the lever comprises a switch operable for switching the selective one-way driver between two modes corresponding to the opposite directions.

* * * * *